US005746365A

United States Patent [19]

Scott

[11] Patent Number: 5,746,365

[45] Date of Patent: May 5, 1998

[54] TAPE AND DISC CARRYING DEVICE

[76] Inventor: Russell Scott, 3482 Uniontown Rd., Uniontwon, Md. 21158

[21] Appl. No.: 537,356

[22] Filed: Oct. 2, 1995

[51] Int. Cl.[6] ..... A45F 3/00

[52] U.S. Cl. ..... 224/676; 224/603; 224/626; 224/684; 224/236

[58] Field of Search ..... 224/600, 601, 224/602, 603, 623, 646, 647, 654, 676, 681, 682, 683, 684, 235, 240, 249, 250, 930, 904, 919, 931, 236; 2/338, 247, 250

[56] References Cited

U.S. PATENT DOCUMENTS

| | | | |
|---|---|---|---|
| 1,219,562 | 3/1917 | Kouyoumjian | 290/1 B |
| 1,838,806 | 12/1931 | Cappa | 290/1 B |
| 2,327,769 | 8/1943 | Claytor | 475/156 |
| 5,358,456 | 10/1994 | Deppert et al. | 475/154 |

*Primary Examiner*—Henry J. Recla
*Assistant Examiner*—Gregory M. Vidovich
*Attorney, Agent, or Firm*—Walter G. Finch

[57] ABSTRACT

The present invention is directed to a belt-type carrier comprising a two-layer belt which is convenient, easily accessible, and adjustable for carrying multiple tapes or CDs. A belt type carrier having features of the present invention comprises a two-layer belt made from a flexible material such as neoprene, canvas, leather, nylon, or any other suitable material. Cassette, tape or CD sized openings are formed between the two layers of the belt. A second embodiment of said invention is a sash type carrier having openings formed therein. A third embodiment of the invention combines a sash carrier and a belt carrier into a single accessory.

3 Claims, 2 Drawing Sheets

TAPE AND DISC CARRYING DEVICE

BACKGROUND OF THE INVENTION

This invention relates to portable storage devices. More particularly this device relates to storage and carrying devices for carrying multiple audio or video tapes and or compact discs.

Portable personal stereos and portable compact disc players abound in society. Commuting to work, exercising, recreational activities and studying are just some of the activities where people rely on music to enhance their enjoyment or to break the monotony. However, the enjoyment can be lessened or monotony can creep back in to the picture when you only have one tape or compact disc (hereinafter CD) to play in your stereo.

Often times people throw a few cassettes or CDs into their backpack, briefcase or purse. Unfortunately these carrying devices have drawbacks for many. Once the cassettes or CDs go into the bag, they are difficult to find under the other clutter of books, wallets, and assorted personal items. Also, many times the plastic cases of the cassettes and CDs are broken by the weight of the other clutter in the bag. Moreover, a backpack, briefcase or purse in not a convenient carrying place for joggers, in-line skaters, bikers, etc. For those who are exercising, there is no convenient way to carry additional tapes or CDs with them during the workout.

U.S. Pat. No. 4,722,464, issued to Wright, discloses a device for carrying a portable cassette player, batteries with pockets for extra cassette tapes. There are two embodiments of this device, one to be worn at the waist and one to be worn from hip to shoulder diagonally across the body. However, this device is meant to hold the cassettes in pockets which are attached to the belt and have a writing surface for identifying the contents. These pockets are not integral to the belt and could be easily torn off or damaged.

Tourist attractions world wide lure droves of people equipped with their video cameras poised to capture every moment of their vacations on tape. Many times several tapes are used during one outing. The bulky camera bags now used are heavy to carry, unwieldy to handle and easily left behind in the rush to reach the next destination.

For the above reasons there is a need for a device which can hold multiple audio or video tapes and/or CDs while providing easy access to these items for people on the go.

SUMMARY OF THE INVENTION

The present invention is directed to a belt and/or sash type carrier that satisfies this need for a convenient, easily-accessible, adjustable device for carrying multiple tapes or CDs. A belt type carrier having features of the present invention comprises a two-layer belt made from a flexible material such as neoprene, canvas, leather, nylon, or any other suitable material. Cassette, tape or CD sized openings are formed between the two layers of the belt.

The opening is secured by a strap which is fastened with a pair of interengaging patches made from a material commonly sold under the trademark Velcro™. The belt is equipped with several of these openings or pockets. The belt is secured around the wearer's waist with a quick-release type buckle.

A second embodiment of the invention is a sash type carrier which is worn from shoulder to hip. There are openings on the front of the sash, the back of the sash or both for added carrying capacity. The sash type carrier is secured on the wearer with a clasp and loop type closure.

A third embodiment of the invention combines the belt carrier and the sash carrier into one device. The ends of the sash carrier attach to the belt carrier to one side in the front and back. This type or carrier provides the user with even more carrying and storage space for cassettes or CDs.

OBJECTS OF THE INVENTION

Therefore, it is an object of this invention to provide for a device which holds multiple tapes or CD's for easy transport and quick access to these items.

It is another object of this invention to provide for a device which holds multiple tapes or CDs that can be worn around the waist in a belt style.

It is yet another object of this invention to provide for a device which holds multiple tapes or CDs that can be worn over the shoulder in a sash style.

It is a further object of this invention to provide for a device which holds multiple tapes or CDs that combines a belt and a sash portion to be worn by the user.

It is still a further object of this invention to provide for a device which hold multiple tapes or CDs that is adjustable and can be worn by anyone.

It is still yet a further object of this invention to provide for a device which has pockets with a Velcro™ for receiving and storing tapes or CDs.

It is still yet a further object of this invention to provide for a device which is made from a flexible fabric having pockets therein for receiving and storing tapes or CDs.

BRIEF DESCRIPTION OF THE DRAWINGS

These and other features, aspects and advantages of the present invention will become better understood with respect to the following description, appended and accompanying drawings where.

DETAILED DESCRIPTION OF THE DRAWINGS

Figure 1:
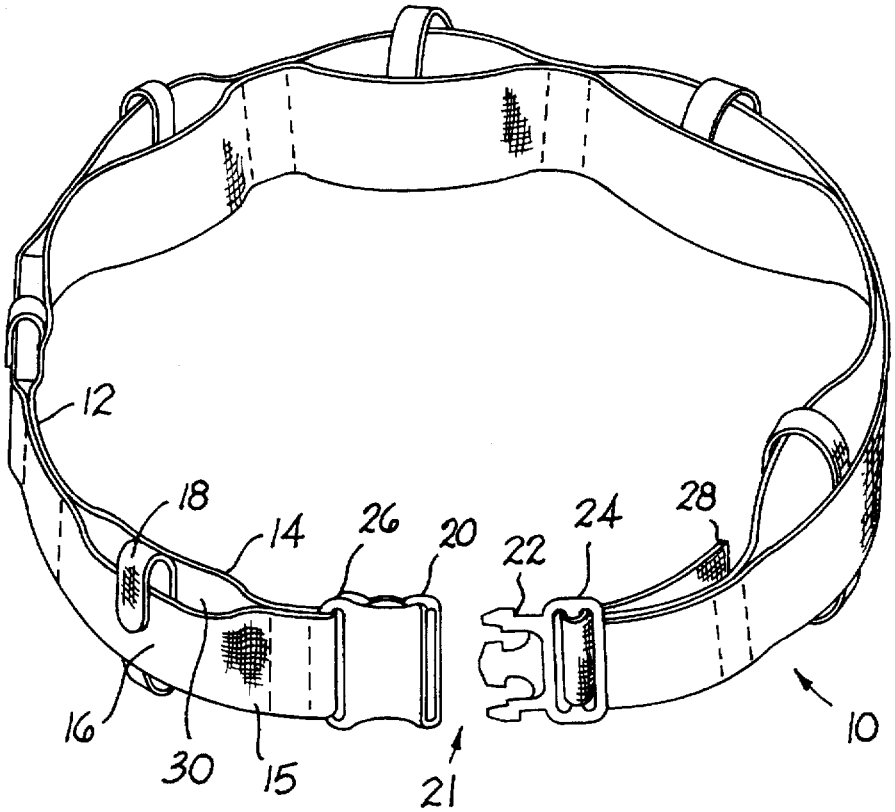
FIG. 1 is an elevational view of one embodiment of the device.

Now referring to FIG. 1, one embodiment of the present invention is shown. The belt 10 version of the present invention is formed from a double layer of fabric 12. The fabric could be neoprene, canvas, nylon, leather or any other suitable flexible fabric. Attached to one end of the belt is the female end 20 of a quick release buckle 21. The fabric which forms the belt 12 is looped through the end 26 of the female portion 20.

Attached to the other end of the belt 10 is the male portion 22 of a quick release buckle 21. The fabric is looped through the end 24 of the male portion 22. There is an extra length of fabric 28 at this end of the belt to provide for easy adjustment of the belt. The belt easily adjusts to fit any size wearer by sliding the male end 22 of the buckle along the length of the belt 28.

Figure 2:
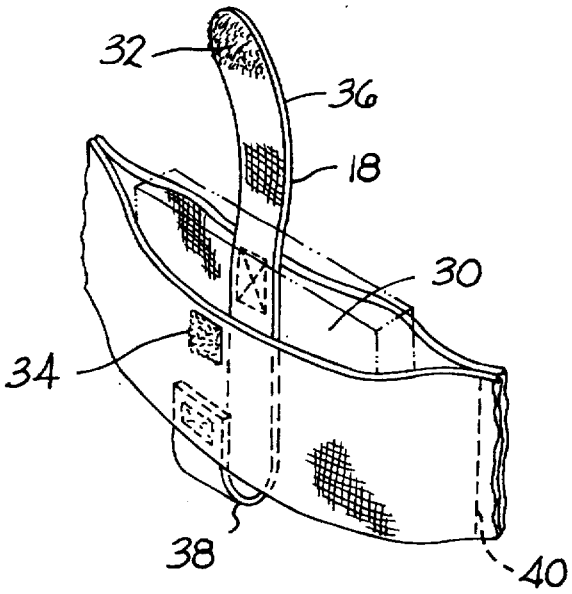
FIG. 2 is an enlarged view of the pockets of FIGS. 1, 3 and 4.

Openings or pockets 30 are formed on one side of the belt between the two-layers 14 and 16 of the belt 12. Generally these openings 30 are formed on the side of the belt which is attached to the female end 20 of the buckle 21. This is because the other end of the belt needs to be loose to provide for size adjustment. The openings 30 are formed by stitching the two layers of fabric together at appropriate intervals. FIG. 2 shows these openings 30 in detail.

There is a strap 18 which is attached to the inside of the opening 30. The bottom portion of the strap 38 serves to retain a cassette or CD within the opening. The top portion of the strap 36 is fixedly attached at one side to one of the fabric layers 14. The strap 18 attaches to the opposite side of the opening by means of interengaging patches 32 and 34 formed from a hook and loop type fabric, such as Velcro™. One patch 32 is positioned on the end 36 strap 18. The corresponding patch 34 is positioned on the outside of the opening 30.

Therefore, when the strap 18 is fastened, the tape or CD is secured in the opening 30. To gain access to the tape or CD in the opening 30, the strap is disengaged and the tape or CD removed from the pocket, see FIG. 2.

Figure 3:
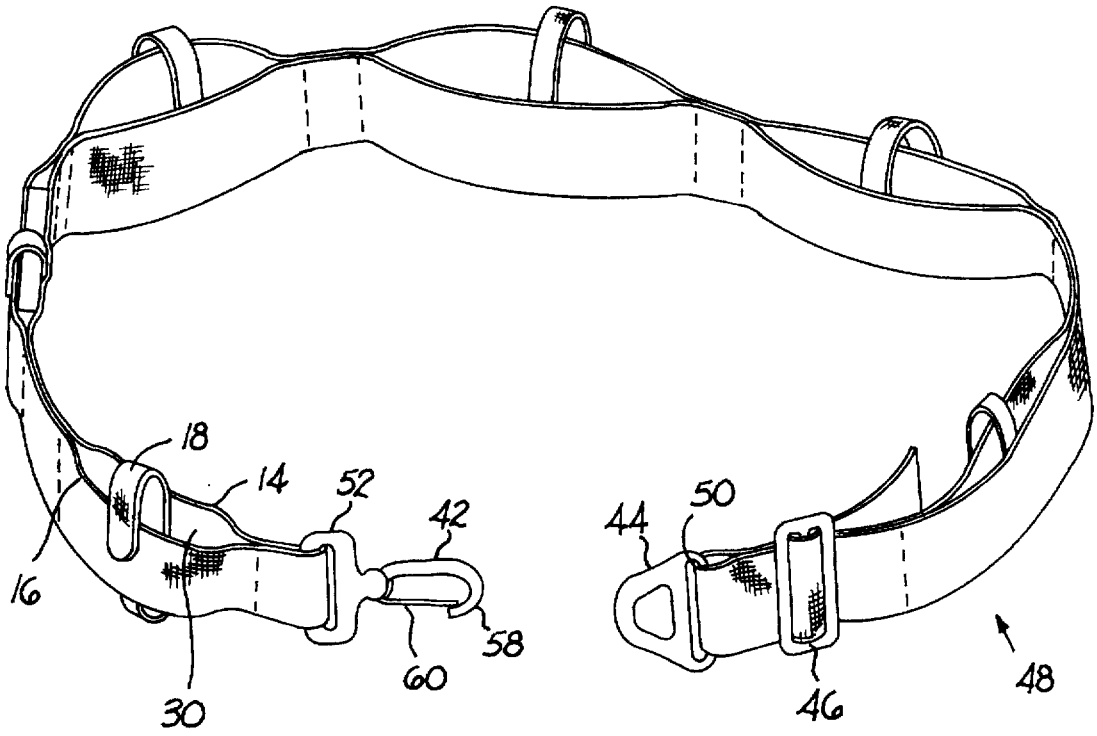
FIG. 3 is an elevational view of a second embodiment of the invention.
Figure 4:
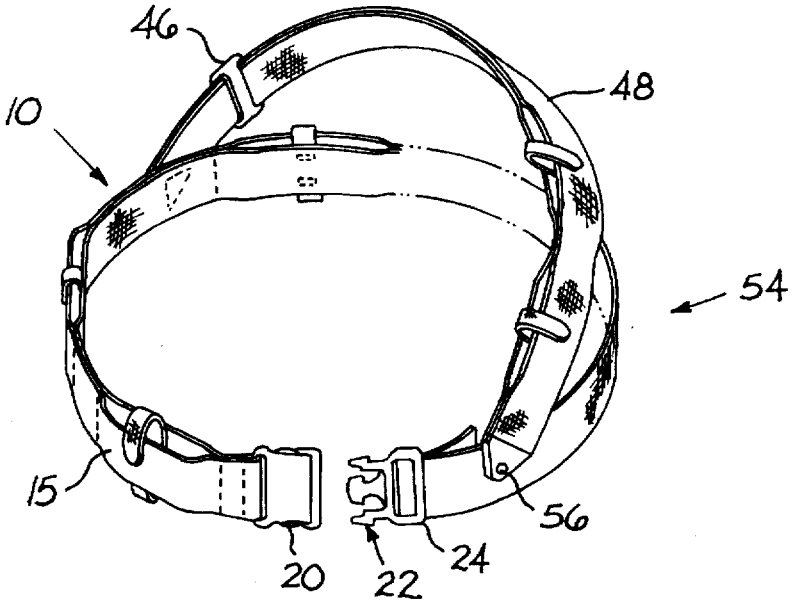
FIG. 4 is an elevational view of a third embodiment of the invention.

A second embodiment, shown in FIG. 3, is designed to be worn over the shoulder in a sash fashion. To secure the sash in place there is a clasp 42 which hooks onto a loop 44. The clasp 42 is swivel mounted onto its base so that the head of the clasp 58 revolves through 360 degrees. To open the clasp the flexible bar 60 is depressed, and released to close.

The sash has a plurality of pockets 30 on one side and an extra length of strap 28 on the opposite end for adjustment. There is a separate adjustment buckle 46 positioned next to the loop 44. To lengthen or shorten the sash, the adjustment buckle 46 is moved along the length of fabric 28. The openings 30 are constructed the same and function the same as the pockets 30 in the belt version.

A third embodiment of the invention combines the sash 48 and belt 10 versions into one accessory 54 which can be worn by the user "bandolier" style. There are pockets 30 on both the sash 48 and the belt 10. Both the sash 48 and the belt 10 are adjustable by means of an adjustment buckle 46 or the end 24 of the male portion 22 of the quick release buckle 21 respectively and an extra length of strap 28. The sash 48 connects to the belt 10 by a single rivet 56 for permanent attachment or any other means of attachment well known in the art, such as clip and pin mechanism or clasp and loop mechanism for a detachable connection.

Although the present invention has been described in considerable detail with reference to the preferred version thereof, other versions are possible. For example, a pocket which is completely sewn along the bottom and has a pocket flap which fully covers its opening for storing valuables could be added to the belt or sash without changing the invention. Therefore, the spirit and scope of the appended claims should not be limited to the description of the preferred versions contained herein.

What is claimed is:

1. A device for storing and transporting articles, comprising:

a two-layer belt having two ends;

means for adjusting the length of said two-layer belt positioned near one of said ends of said belt;

a male end of a quick release buckle attached to one of said ends of said two-layer belt for securing said two-layer belt on a person;

a female end of said quick release buckle attached to other of said ends of said two-layer belt adapted to engage said male end;

a plurality of pockets formed in between said layers of said two-layer belt, each said pocket having a top opening and a bottom opening formed along the length of said belt;

a plurality of retaining straps, the width of each of said straps being less than the length of each of said openings, each of said straps having two ends wherein one of said ends is fixedly attached to an inside face of one of said pockets and loops across said one pocket to lie against the opposite inner face of said one of said pockets to thereby form a bottom thereof, and another of said ends fits across the top of said one pocket; and a pair of interengaging patches associated with each of said pockets and said straps for closing of each of said pockets wherein one each of said pair of interengaging patches is attached to said another of said ends of said strap and the other of said pair of interengaging patches is attached to an outside of said pocket such that when said interengaging patches are fastened together each of said packets is closed.

2. A device for storing and transporting articles, comprising:

a two-layer sash having two ends;

means for adjusting the length of said two-layer sash positioned near one of said ends of said two-layer sash;

a clasp portion of a fastener attached to one of said ends of said two-layer sash for securing said two-layer sash on a person;

an eye fastener portion attached to other of said ends of said two-layer sash adapted to engage said clasp;

a plurality of pockets formed in between said layers of said two-layer sash, each said pocket having a top opening and a bottom opening formed along the length of said sash;

a plurality of retaining straps, the width of each of said straps being less than the length of each of said openings, each of said straps having two ends wherein one of said ends is fixedly attached to an inside face of one of said pockets and loops across said one pocket to lie against the opposite inner face of said one of said pockets to thereby form a bottom thereof, and another of said ends fits across the top of said one pocket; and a pair of interengaging patches associated with each of said pockets and said straps for closing of each of said pockets wherein one each of said pair of interengaging patches is attached to said another of said ends of said strap and the other of said pair of interengaging patches is attached to an outside of said pocket such that when said interengaging patches are fastened together each of said pockets is closed.

3. A device for storing and transporting articles, comprising:

a two-layer sash having two ends;

means for adjusting the length of said two-layer sash positioned near one of said ends of said two-layer sash;

a two-layer belt having two ends, wherein said ends of said two-layer sash portion are attached to said two-layer belt portion;

means for adjusting the length of said two-layer belt positioned near one of said ends of said two-layer belt;

a male end of a quick release buckle attached to one of said ends of said two-layer belt for securing said two-layer belt and said two-layer sash on a person;

a female end of said quick release buckle attached to other of said ends of said two-layer belt adapted to engage said male end;

a plurality of pockets formed in between said layers of said two-layer sash and said layers of said two-layer belt;

a plurality of retaining straps, the width of each of said straps being less than the length of each of said pockets, each of said straps having two ends wherein one of said ends is fixedly attached to an inside face of one of said pockets and loops across said one pocket to lie against the opposite inner face of one of said said pockets to thereby form a bottom thereof, and another of said ends fits across the top of said one pocket; and a pair of interengaging patches associated with each of said pockets and said straps for closing of each of said pockets wherein one each of said pair of interengaging patches is attached to said another of said ends of said strap and the other of said pair of interengaging patches is attached to an outside of said pockets such that when said interengaging patches are fastened together each of said pockets is closed.

* * * * *